United States Patent [19]

Rogers

[11] 4,293,852

[45] Oct. 6, 1981

[54] CAPACITIVE ARTICLE REMOVAL ALARM

[75] Inventor: Groby W. Rogers, London, England

[73] Assignee: Lawrence Security Services Ltd., London, England

[21] Appl. No.: 100,372

[22] Filed: Dec. 5, 1979

[30] Foreign Application Priority Data

Dec. 8, 1978 [GB] United Kingdom ..... 47724/78

[51] Int. Cl.[3] ..... G08B 13/14

[52] U.S. Cl. ..... 340/568; 307/125; 331/65; 340/562

[58] Field of Search ..... 340/568, 562; 307/125, 307/116; 331/65

[56] References Cited

U.S. PATENT DOCUMENTS 2,064,980 12/1936 Kelly ..... 340/562

3,824,460 7/1974 Gustafson ..... 340/562

*Primary Examiner*—Glen R. Swann, III

*Attorney, Agent, or Firm*—Murray and Whisenhunt

[57] ABSTRACT

The alarm system comprises a sensing circuit 12 which includes two electrical conductors 10, 11 spaced from but adjacent each other and adjacent to the predetermined position to be occupied by at least one item when in use. The sensing circuit includes a signal generator responsive to the capacitance present between the two conductors to provide a first output condition indicative of a substantially constant capacitance value present between the electrodes due to the undisturbed presence of the item and to provide a second output condition indicative of a change in capacitance value due to the disturbance of the item or items present. The output of the sensing circuit is received by an alarm actuating circuit 13 which causes actuation of an alarm element when the output condition from the sensing circuit changes significantly to cause the actuating circuit to trigger due to the movement of the item from its predetermined position.

5 Claims, 3 Drawing Figures

CAPACITIVE ARTICLE REMOVAL ALARM

BACKGROUND TO THE INVENTION

The invention relates to an alarm system capable of detecting when an article is removed from a predetermined position.

In known alarm systems used to deter or detect shoplifters for example, each article on an open display has been interconnected in a loop by means of a wire coupled to an alarm. Such a system is obtrusive and tends to detract from the display. Adding or removing articles with such a display requires disconnecting the interconnected wires in the loop which can become tedious.

An alternative known system makes use of pressure pads which are connected to an alarm and removal of an article triggers this alarm. In such a system it is necessary to have a pressure pad for each article on display if removal of one is to be detected and thus changes in the number of articles displayed requires addition or removal of one or more pads and changes in the system connections. Thus such a system does not lend itself to frequent changes in the display.

It has also been proposed to use the capacitive effect of displayed articles to trigger an alarm by a system which uses a metal sheet as a conductor connected to an alarm system and each displayed article is placed on this sheet which overlies a shelf. In such a system effectively it was necessary to measure the capacitance of the articles between this electrode and earth and such a system has been shown to be unreliable due to stray capacitance effects and such a system could instigate an alarm condition merely by a customer being in the vicinity of the display which proves to be an embarrassment to both the customer and the shop-keeper.

The present invention is concerned with a system which overcomes the above drawbacks to provide a reliable, flexible and typically unobtrusive system which can cope with a number of articles together if required.

SUMMARY OF THE INVENTION

According to the invention there is provided an alarm system for indicating the removal of an article from a predetermined position comprising:

(a) sensing circuit means including (i) two electrical conductors spaced from but adjacent each other and for positioning adjacent to the predetermined position to be occupied by at least one article when in use, and (ii) signal generating means responsive to the capacitance present between these conductors to provide a first output condition indicative of substantially constant capacitance value present between the electrodes due to the undisturbed presence of said at least one article and to provide a second output condition indicative of a change in capacitance value present due to the disturbance of said at least one article, and (b) alarm actuator means responsive to the output of said sensing circuit means to provide an alarm indication as a result of a change in the output condition of said sensing circuit means whenever a change in capacitance due to the removal of an article occurs.

According to a further aspect of the invention there is provided a method of detecting and indicating when an article has been removed from a predetermined position comprising:

providing two electrical conductors spaced from but adjacent each other and adjacent the predetermined position to be occupied by at least one said article, sensing the capacitance present between these conductors to provide a first output condition indicative of substantially constant capacitance value present between the electrodes due to the undisturbed presence of said at least one article and to provide a second output condition when a change in capacitance value due to the disturbance of said at least one article occurs, and actuating an alarm indicator whenever a change in the output condition occurs as a result of the removal of said article.

BRIEF DESCRIPTION OF THE DRAWINGS

The invention will now be described by way of example with reference to the accompanying drawings, in which.

DESCRIPTION OF PREFERRED EMBODIMENT

Figure 1:
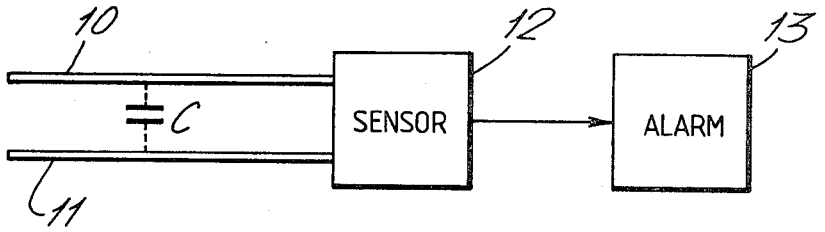
FIG. 1 shows a block diagram of the system of the invention.

In the basic system of FIG. 1, the item or items to be displayed will be positioned such that they will overlie the electrodes 10, 11 which will typically be provided on top of a display stand but not necessarily in the straight configuration indicated. The effective capacitance of the items so placed is indicated by capacitor c. The electrodes 10 and 11 are connected to the sensor 12 which produces an output level indicative of the change in the capacitance c. Any object removed from across the electrodes 10 and 11 will cause a rapid change in capacitance and thus the sensor 12 will detect this change and the output thereof will rise. The output of sensor 12 is received by alarm block 13 which compares the sensor level with a predetermined threshold and effects an alarm condition when the threshold is exceeded.

Figure 2:
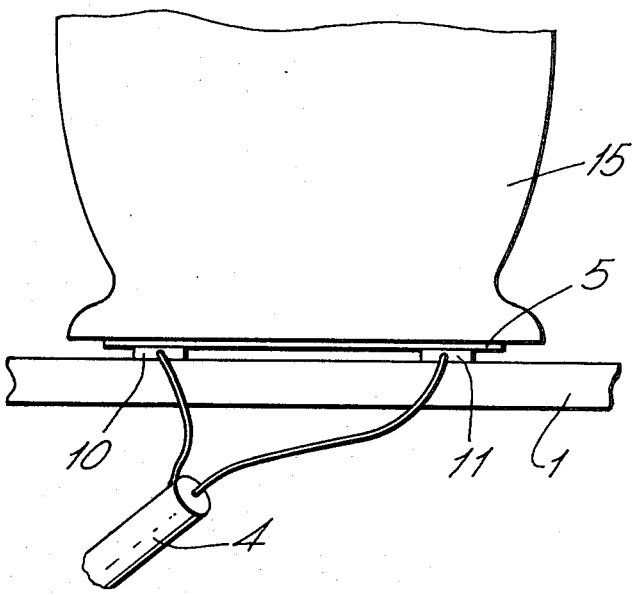
FIG. 2 shows one configuration for arranging the electrodes adjacent to an object to be protected by the alarm.

The way in which the electrodes can be arranged is shown in FIG. 2.

The shelf 1 is provided on its upper face with two metallic electrode strips 10, 11 which are arranged typically in an interleaved pattern so that, irrespective of the position of placing an article 15 on the shelf, the base of the article will overlie the two electrodes 10 and 11. The article is assumed to be metallic, or to incorporate metal at or near its base, or to carry a sticker or tag 5 which is made of or incorporates metal.

The strips are advantageously self-adhesive, and may be for example ¾ inch apart, and one-eighth to three-eighths of an inch in width. Thin wire could also be used. The sticker could be a small disc of silver paper, for use in the case of glass, china etc. When the disc is placed over the strips, there is an increase of capacitative bridging of the strips 10 and 11.

The two electrode strips in this example are connected by the inner and outer portions of a coaxial cable 4 to the sensor arrangement.

Although the electrodes 10 and 11 are shown on the upper surface of the shelf in contact with the article 15 (or metallic sticker 5), it would also be possible to disguise the electrodes by covering these with a thin dry material (e.g. cloth), and placing the article on the cloth. Alternatively if the shelf were thin it may be possible to provide the electrodes on its lower surface, although in these latter configurations the sensitivity of the system would be somewhat reduced.

Figure 3:
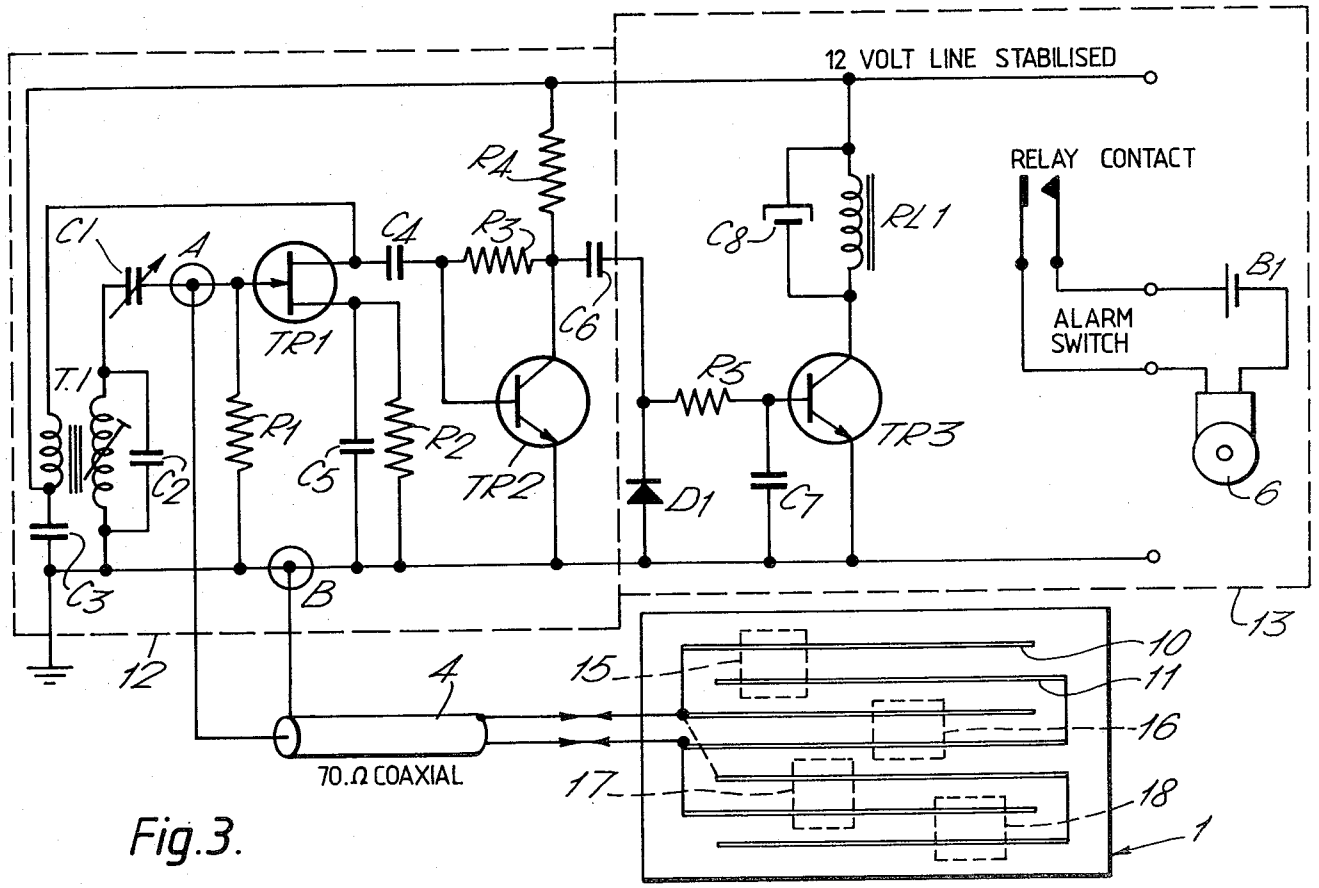
FIG. 3 shows one embodiment for realising the system of FIG. 1.

An arrangement for realising the system of FIG. 1 is shown in FIG. 3. The electrodes 10 and 11 are shown interleaved by way of example and suitable positions for a number of articles 15–18 are shown thereon. The electrodes are connected via cable 4 to points A and B. The sensor 12 consists of a high impedance oscillator employing a field effect transistor (FET) TR1 (e.g. 2N3819). Components associated with the oscillator include inductance $T_1$, capacitors $C_1$, $C_2$, $C_3$ and $C_5$ and resistors $R_1$ and $R_2$. The circuit is arranged to go into, and out of, oscillation by the change of capacity occuring between the strips.

The setting of the oscillator is controlled by the variable capacitor $C_1$ in the gate circuit of the FET, and which is affected by the loading of the shelf; when the shelf is loaded with articles, the capacitor $C_1$ is adjusted so that the oscillator is just not oscillating. When an article is removed from the shelf, the capacity at the shelf decreases, and allows the oscillator to start working.

The output of the oscillator is typically selected to be at R.F. frequency, e.g. 450–470 Kcs., and this output is passed via capacitor $C_4$ to the amplifier comprised of transistor TR2 with associated resistors $R_3$ and $R_4$. The output from this transistor passes via capacitor $C_6$ and is rectified by the diode D1, and the DC content is fed to the driving circuit comprising power transistor TR3 and associated resistor $R_5$ and capacitor $C_7$ which circuit actuates the relay circuit ($RL_1$ and $C_8$) when this DC level exceeds a predetermined threshold. The contacts of the relay are used to switch on any convenient alarm system shown here as a bell 6 powered by battery $B_1$.

The oscillator radiates only micro-watts, and only does so when an article is removed. The oscillator is not in a state of oscillation, when everything is normal at the shelf. When in this normal state, the supply current used by the equipment is very low. The maximum current is used when an article is removed from the shelf, and this current mainly consists of that which is consumed by the power transistor and the relay used.

It will be appreciated that the oscillator circuit and the relay could be miniaturised and encapsulated. The relay although shown as an electro-mechanical device, this could alternatively comprise a solid state switch.

By use of a display device coupled to respective relays for each of a plurality of shelves, there may be obtained an indication of which shelf, amongst many, is subject to the removal of an article.

When the alarm or indicator means installed at a point remote from the shelf, e.g. at a supervisory post or assistant's location in a shop, the device provides an automatic safeguard against unobserved removal of articles, and moreover dependent on the type of alarm (i.e. visual or audible) can give notification of an alarm condition without giving any indication of that fact to the person removing the article.

The placing of the electrodes as a pair in close proximity to each other and over which the article is placed so as to bridge the electrodes, ensures that stray capacitance effects due to customers or assistants moving in the vicinity of the display are minimised and thus reduce the possibility of false alarm conditions.

Although the system has been described generally for use with an 'article' comprising an object for display, the system is also capable of detecting the movement of other 'articles' away from a predetermined position for example such as in opening of a door or window, a face of which could be provided with a metallic strip for example in the vicinity of the electrodes and any movement thereof causing actuation of the alarm.

I claim:

1. An alarm system for indicating the removal of an article from a predetermined position comprising:

(a) sensing circuit means including (i) two electrical conductors spaced from but adjacent each other and for positioning adjacent to the predetermined position to be occupied by at least one article when in use, and (ii) signal generating means responsive to the capacitance present between these conductors to provide a first output condition indicative of substantially constant capacitance present between these conductors due to the undisturbed presence of said at least one article and to provide a second output condition indicative of a change in capacitance value present due to the disturbance of said at least one article, and (b) alarm actuator means responsive to the output of said sensing circuit means to provide an alarm indication responsive to said second output condition of said sensing circuit means.

2. A system according to claim 1, wherein the signal generating means comprises an oscillator capable of providing a first output condition in which no oscillation occurs during normal operation and a second output condition in which oscillation occurs on movement of an object due to a change in capacitance in the oscillator circuit as sensed between the two conductors, and adjustment means are provided for establishing the first output condition to compensate for the type and number of articles present, when in use.

3. A system according to claim 2, wherein the alarm actuator means includes a driver circuit for rectifying the oscillator output and actuating an alarm element when the rectified oscillator output exceeds a predetermined level.

4. A system according to claim 1, wherein the two electrical conductors of the sensing circuit means comprise a substantially parallel adjacent pair of metallic electrodes.

5. A method of detecting and indicating when an article as been removed from a predetermined position comprising:

providing two electrical conductors spaced from but adjacent each other and adjacent the predetermined position to be occupied by at least one said article, sensing the capacitance present between these conductors to provide a first output condition indicative of substantially constant capacitance value present between the electrodes due to the undisturbed presence of said at least one article and to provide a second output condition when a change in capacitance value due to the disturbance of said at least one article occurs, and actuating an alarm indicator whenever a change in the output condition occurs.

* * * * *